US005522159A

United States Patent [19]

Lundberg

[11] Patent Number: 5,522,159

[45] Date of Patent: Jun. 4, 1996

[54] DRYING SHED

[75] Inventor: Kjell Lundberg, Skellefteå, Sweden

[73] Assignee: Utec Sm AB, Skelleftea, Sweden

[21] Appl. No.: 211,783

[22] PCT Filed: Oct. 9, 1992

[86] PCT No.: PCT/SE92/00711

§ 371 Date: Jun. 6, 1994

§ 102(e) Date: Jun. 6, 1994

[87] PCT Pub. No.: WO93/08437

PCT Pub. Date: Apr. 29, 1993

[30] Foreign Application Priority Data

Oct. 16, 1991 [SE] Sweden ..... 9103011

[51] Int. Cl.[6] ..... F26B 3/00

[52] U.S. Cl. ..... 34/490; 34/488; 34/489; 34/191; 34/218; 34/227

[58] Field of Search ..... 34/487, 488, 489, 34/490, 507, 191, 210, 218, 227

[56] References Cited

U.S. PATENT DOCUMENTS

| | | | |
|---|---|---|---|
| 1,536,735 | 5/1925 | Thelen | 34/489 |
| 1,955,374 | 4/1934 | Cobb et al. | 34/191 |
| 3,131,034 | 4/1964 | Marsh | 34/191 |
| 3,659,352 | 5/1972 | Cook | 34/191 |
| 3,727,556 | 4/1973 | Adams | 34/102 |
| 4,356,641 | 11/1982 | Rosenau | 34/191 |
| 5,195,251 | 3/1993 | Gyurcsek et al. | 34/191 |
| 5,226,244 | 7/1993 | Carter et al. | 34/191 |

FOREIGN PATENT DOCUMENTS

| | | |
|---|---|---|
| 8801718 | 3/1988 | WIPO . |

*Primary Examiner*—Denise L. Gromada
*Attorney, Agent, or Firm*—John Lezdey & Associates

[57] ABSTRACT

A drying shed includes at least one drying chamber (2) for accommodating wood (3) to be dried in a known manner, and further includes a drying unit arranged in the drying chamber and comprising a heat-exchange battery (6) and fans (4). The invention is characterized in that respective fan wheels or impellers are intended to be driven by a hydraulic motor. The hydraulic motor may be a reversible motor.

5 Claims, 1 Drawing Sheet

DRYING SHED

The present invention relates to a drying shed of the kind defined in the preamble of claim 1.

A drying shed will normally comprise a drying chamber in which the wood to be dried is stacked in a known manner, and a drying unit. The drying unit is comprised of heating batteries and fans or blowers which are intended to force warm air through the wood stacks in the heating chamber. In order to ensure that the wood is dried as evenly as possible, the direction of warm air flow is reversed at regular intervals. This change in the direction of air flow can be achieved by changing the direction of fan rotation, although this will result in an impaired efficiency in one flow direction. This drawback can be alleviated by installing in the shed an even number of fans and by rotating half of the fans in the "correct" direction and the other half in the opposite direction. Thus, in this arrangement half of the fans will work at optimum efficiency while the other half of the fans will work at a lower efficiency. The direction of rotation of respective fans can be reversed, so as to obtain a uniform warm-air flow pattern irrespective of the direction in which the air flows,, Another method of maintaining full fan efficiency is to rotate the fans through 180° or to house the fans in an air-reversing cowling or duct.

The fan motors known hitherto are driven electrically. This makes it relatively expensive to control variations in motor speeds and to control reversing of the directions in which they rotate. Furthermore, because the motors cannot withstand unduly high temperatures, present day drying temperatures are restricted to about 60° C. However, there is a desire to increase this temperature to above 100° C. The reliability of electric motors in operation is jeopardized because the motors work in a warm and moist atmosphere, causing the motors to break down and in need of repair.

The object of the present invention is to improve the operational reliability of drying sheds and therewith reduce the number of breakdowns while enabling the sheds to operate at much higher temperatures, up to twice the present day temperature levelös, i.e. temperatures of up to 100°–120° C. This object is achieved with a drying shed having the characteristic features set forth in the following claims.

Figure 1:
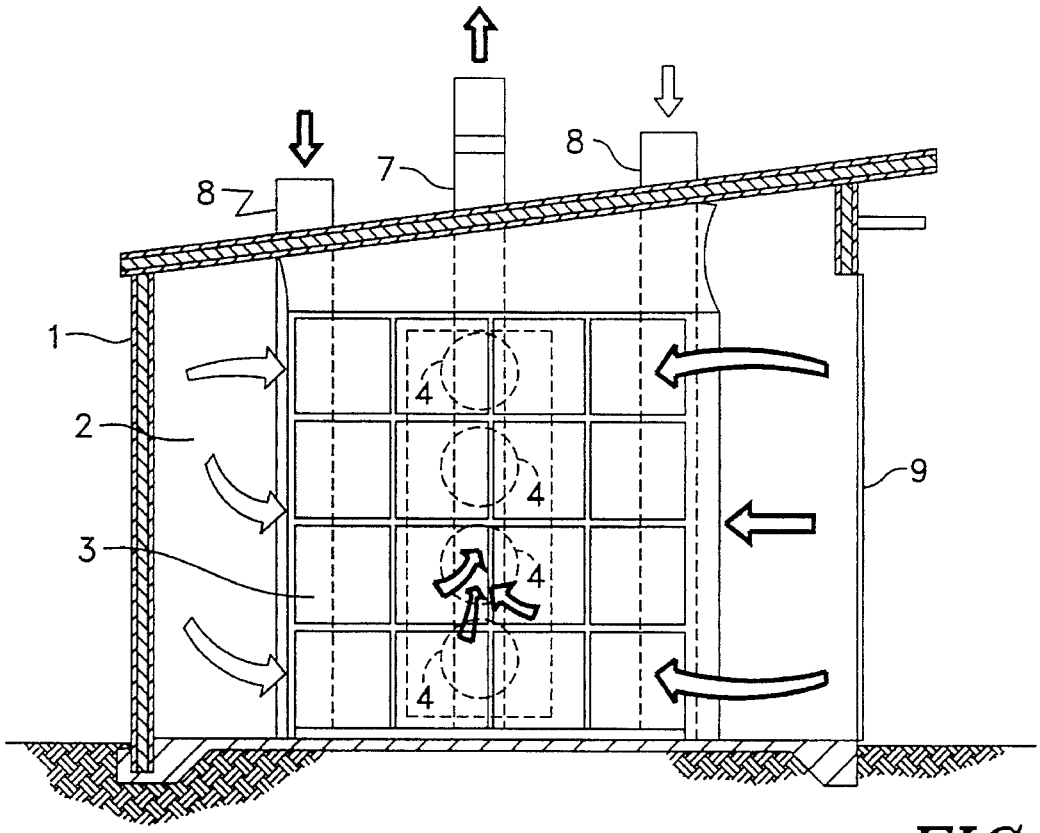
Figure 2:
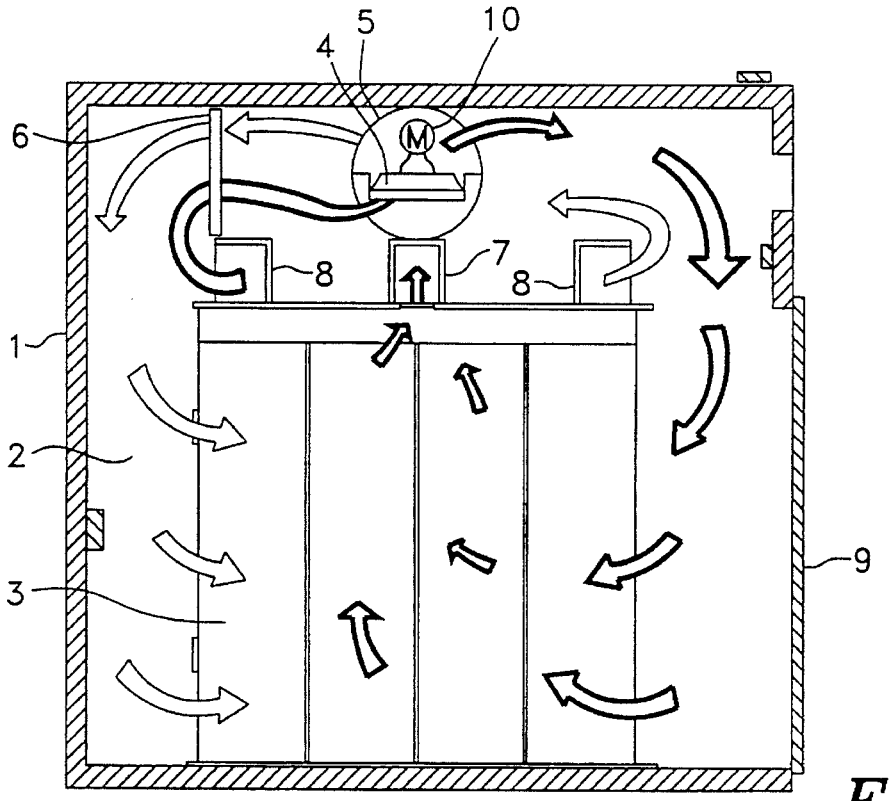

The invention will now be described in more detail with reference to an exemplifying embodiment thereof and also with reference to the accompanying drawing, in which FIG. 1 illustrates a drying shed schematically and in side view and FIG. 2 illustrates the shed shown in FIG. 1 from above, said Figures showing the component apparatus of said shed.

The drawing illustrates a thermally insulated building 1 which houses a drying chamber 2. Wood which is to be dried is stacked in the chamber 2 in a known manner, as shown at 3, such that warm air is able to pass between the stacks and also over the individual pieces of wood located in the stacks. In addition to the wood stacks, the drying chamber 2 also accommodates a drying unit comprising fans 4, in the illustrated case four fans, which are positioned vertically one above the other. Guide plates 10 leading to an air-reversing duct 5 extend obliquely on both sides of the fans to form a sector having an angle of about 45°. The duct 5 is rotatably mounted on a vertical axle. The drying unit also includes a heating battery, comprising one or more heating elements 6 (of which only one heating element is shown in the illustrated embodiments, see FIG. 2). The drying chamber 2 also includes an outlet in the form of a chimney 7. Ambient air is taken into the drying chamber 3 through two inlet ducts 8. The building 1 is also provided with a door 9 through which wood stacks are moved into and out of the building. The manner in which the drying chamber operates will now be described in brief.

Cold ambient air is drawn by the fans 4 in through the left inlet duct 6 shown in the Figures, and is led down from the duct and through the heating element 6, where it is heated. The heated air is then led into the drying chamber and through the wood stack, and then out through the chimney 7. The direction of the airflow is changed after a given predetermined period of time has elapsed, so that the drying process will be as uniform as possible. This changing or reversing of the direction of the airflow is effected by rotating the air-reversing duct 5 through 45°, such that ambient air will now be drawn into the drying chamber 2 through the inlet duct 8 shown to the right in the Figures. The air will then flow in the directions of the chain arrows.

It will be understood that heating elements may also be mounted symmetrically on the right side of the drying unit (FIG. 2). The drive motors connected to the fans will be exposed to the warm drying air and the humid atmosphere. In order to ensure that the fans will operate more reliably, the fans are driven by hydraulic motors 10 (FIG. 2) in accordance with the invention, such motors being insensitive to moisture and are also able to withstand much higher temperatures than electric motors. This enables the temperature of the drying air to be raised considerably when practicing the present invention, from a drying air temperature of about 60° C., which is normal in present-day processes, to twice this temperature, i.e. about 100°–120° C. The fan speeds can be controlled continuously and with the aid of simple, operationally reliable hydraulic control means, thereby enabling a continuous, variable airflow to be obtained in the absence of complicated frequency control. When practicing the present invention, the negative effect obtained when reversing the fans, as in the case of electrically driven fans, does not occur if one or more of the fans should stop for some reason or other.

Many drying sheds operate with reversible fans instead of air-reversing ducts. This means that the direction in which the motor rotates must be changed, which can readily be achieved reliably with the aid of the present invention. The need for complicated electrical fan-motor control systems is eliminated.

It will be understood by the person skilled in this art that the drying shed may have any known construction without departing from the concept of the invention—i.e. the invention can be applied in all types of present-day drying sheds comprising one or more drying chambers and with varying positioning of the fans.

I claim:

1. A method for drying a stack of wood at temperatures of up to about 120° C. in a drying shed having a drying chamber, a drying unit and reversible air ducts; said drying unit having an even-numbered plurality of substantially vertically and symmetrically rotatable mounted fans driven by reversible hydraulic motors; wherein one-half of said fans are rotated so that one-half of said fans operate at maximum efficiency and the other half of said fans operate at a less than maximum efficiency; and a heat exchange battery; said method comprising the steps of:

a) drawing ambient air into said drying chamber through heating means, b) directing the heated air through said wood stack and out through said chamber, and c) changing the direction of the airflow through said wood stack by reversing said ducts at a predetermined time so that ambient air will flow through the stack.

2. A drying shed for drying wood at temperatures of up to 120° C. comprising:

a housing;

at least one drying chamber in said housing;

said drying chamber having an air outlet means;

a drying unit having an even-numbered plurality of substantially vertically and symmetrically rotatable mounted fans driven by reversible hydraulic motors; wherein one-half of said fans are rotated so that one-half of said fans operate at maximum efficiency and the other half of said fans operate at a less than maximum efficiency; and a heat exchange battery.

3. The drying shed of claim 2 wherein said heat exchange battery comprises a plurality of heating elements.

4. The drying shed of claim 2 including an air reversing duct.

5. The drying shed of claim 2 including air inlet means in said drying chamber.

* * * * *